US008997413B2

(12) United States Patent
Anderson

(10) Patent No.: US 8,997,413 B2
(45) Date of Patent: Apr. 7, 2015

(54) MODULAR BOOTH SYSTEM

(71) Applicant: Extraordinary Offerings, Ltd., Wanchai (HK)

(72) Inventor: Mark J. Anderson, La Jolla, CA (US)

(73) Assignee: Extraordinary Offerings, Ltd., Wanchai (HK)

( * ) Notice: Subject to any disclaimer, the term of this patent is extended or adjusted under 35 U.S.C. 154(b) by 23 days.

(21) Appl. No.: 13/968,350

(22) Filed: Aug. 15, 2013

(65) Prior Publication Data

US 2015/0047279 A1 Feb. 19, 2015

(51) Int. Cl.
*E04B 2/74* (2006.01)
*E04H 1/12* (2006.01)

(52) U.S. Cl.
CPC ..... *E04H 1/125* (2013.01); *E04H 1/12* (2013.01); *E04B 2/7448* (2013.01); *E04B 2002/7461* (2013.01)

(58) Field of Classification Search
USPC ..... 52/127.1, 238.1, 239, 272, 489.1, 578, 52/588.1, 592.1
See application file for complete search history.

(56) References Cited

U.S. PATENT DOCUMENTS 2,056,328 A * 10/1936 Price ..... 52/243
2,081,368 A * 5/1937 Pretot ..... 52/489.1
3,971,179 A * 7/1976 Bodocsi et al. ..... 52/223.11
4,497,148 A * 2/1985 Lopez ..... 52/126.3
5,058,347 A * 10/1991 Schuelke et al. ..... 52/239
5,211,502 A * 5/1993 Upham-Hill ..... 403/353
5,313,752 A * 5/1994 Hatzinikolas ..... 52/243
5,491,943 A * 2/1996 Vondrejs et al. ..... 52/239
5,561,960 A 10/1996 Minnick et al. ..... 52/578
5,644,878 A * 7/1997 Wehrmann ..... 52/287.1
5,687,859 A * 11/1997 Miller ..... 211/189
5,746,040 A * 5/1998 Young et al. ..... 52/775
6,098,358 A * 8/2000 Waalkes et al. ..... 52/239
6,115,997 A * 9/2000 Burrow et al. ..... 52/238.1
6,295,764 B1 * 10/2001 Berridge et al. ..... 52/36.5
6,802,168 B1 10/2004 Minnick ..... 52/592.1
7,565,772 B2 * 7/2009 Waalkes et al. ..... 52/36.1
7,797,901 B2 * 9/2010 Near ..... 52/481.1
8,322,102 B2 12/2012 Krieger ..... 52/489.1
8,661,765 B2 * 3/2014 Schaefer et al. ..... 52/655.1
2009/0090076 A1 * 4/2009 Abusada et al. ..... 52/239
2009/0133354 A1 5/2009 Spear et al. ..... 52/588.1
2010/0307080 A1 * 12/2010 Parshad et al. ..... 52/220.7
2011/0067331 A1 3/2011 Grinsted ..... 52/309.4
2011/0099921 A1 5/2011 Fitzgerald et al. ..... 52/127.1
2012/0297698 A1 11/2012 Edwards ..... 52/81.6
2013/0056995 A1 3/2013 Hudson et al. ..... 292/181

* cited by examiner

*Primary Examiner* — Jeanette E Chapman
*Assistant Examiner* — James Buckle, Jr.
(74) *Attorney, Agent, or Firm* — Pillsbury Winthrop Shaw Pittman LLP

(57) ABSTRACT

A modular booth system comprising support posts, support beams, and corner support posts. The system includes features which facilitate enhanced structural rigidity of an assembled embodiment of the system. These features may include one or more of dual locking pins and slots and biased translatable locking pins. The system may facilitate the removable engagement of accessories, for example, through the provision of one or more accessory engagement channels.

5 Claims, 5 Drawing Sheets

MODULAR BOOTH SYSTEM

FIELD OF THE DISCLOSURE

This disclosure relates to modular booth systems used for the vertical support of wall panels, and more particularly to a modular booth system comprising an improved assembly providing enhanced structural stability and interchangeability of booth accessories.

BACKGROUND

Modular booth systems are known. These systems generally require the assemblage of multiple components to form rigid frames and/or support structures for supporting wall panels or the like.

SUMMARY

One aspect of the disclosure relates to a modular booth system including support posts, support beams, and corner support post components which can be assembled to provide vertical support of wall panels and to facilitate construction of temporary structures. The system may comprise a first support post and a second support post. The first support post may comprise a first end and a second end opposite the first end. The first support post may comprise a first surface running from the first end to the second end thereof. The first surface may comprise two adjacent pins extending therefrom, wherein the pins are horizontally disposed during the vertical support of wall panels. The first support post may comprise a second surface running from the first end to the second end, wherein the second surface faces opposite the first surface. The second surface may comprise a panel engagement channel running longitudinally along the first support post, wherein the panel engagement channel may be configured to engage a first side edge of a first wall panel. The first support post may comprise a first side surface running from the first surface to the second surface. The first side surface may comprise one or more accessory engagement channels running longitudinally along the first support post. The accessory engagement channels may be configured to engage accessories therein.

The second support post may comprise a first end and a second end opposite the first end. The second support post may comprise a first surface running from the first end to the second end thereof. The first surface may comprise two adjacent slots communicating through the first surface, wherein the slots may be horizontally disposed during the vertical support of wall panels. The second support post may comprise a second surface running from the first end to the second end, wherein the second surface faces opposite the first surface. The second surface may comprise a panel engagement channel running longitudinally along the second support post, wherein the panel engagement channel may be configured to engage a first side edge of a second wall panel. The second support post may comprise a first side surface running from the first surface to the second surface. The first side surface may comprise one or more accessory engagement channels running longitudinally along the second support post. The accessory engagement channels may be configured to engage accessories therein.

Assembly of the component so of the system may be facilitated via the adjacent slots of the first surface of the second support post in an engagement with the adjacent pins of the first surface of the first support post. This engagement may substantially eliminate rotation of the first support post relative the second support post during the vertical support of wall panels thereof.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
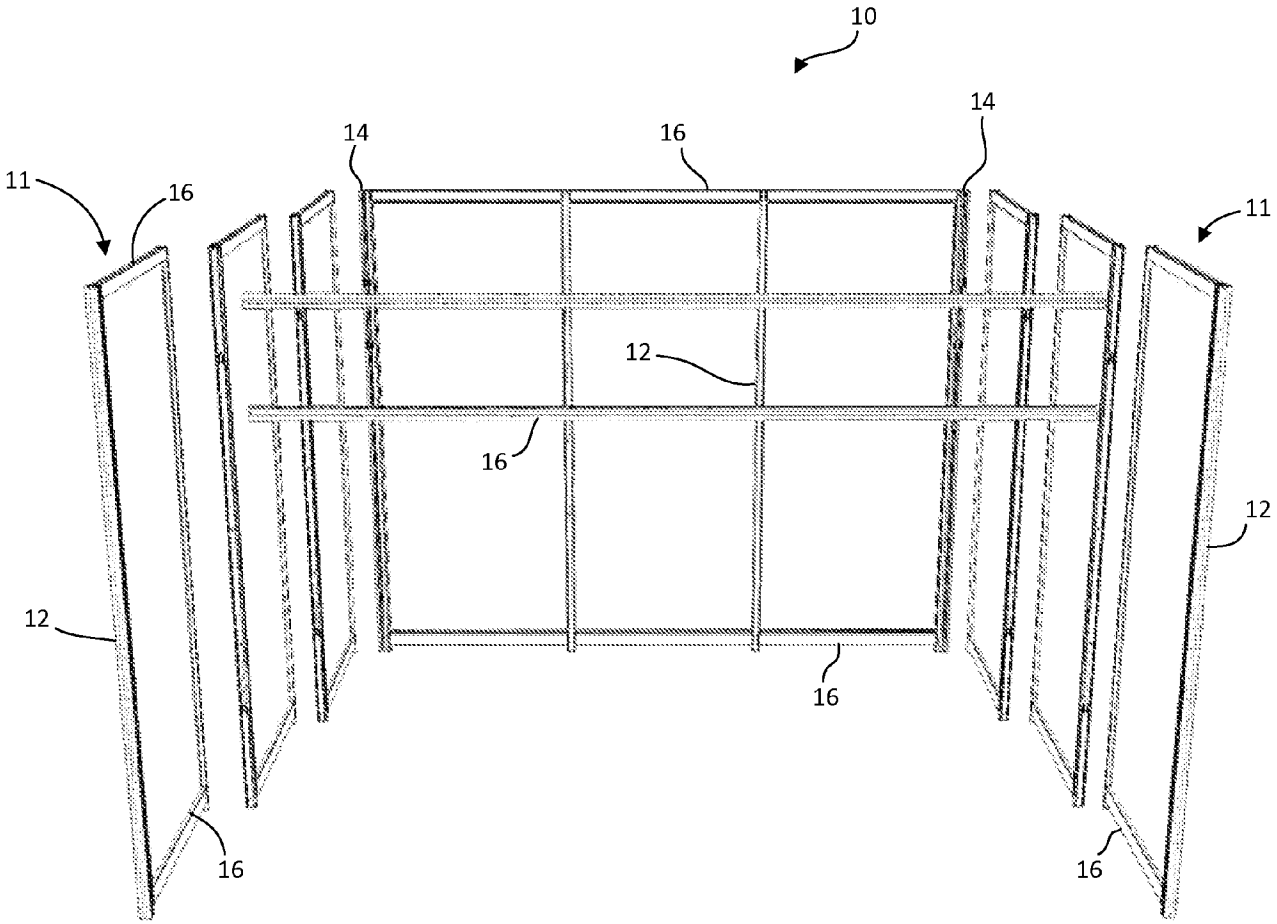
FIG. 1 illustrates a modular booth system according to an embodiment of the present invention comprising panel support posts, corner support posts, and support beams used for the vertical support of wall panels.
Figure 2:
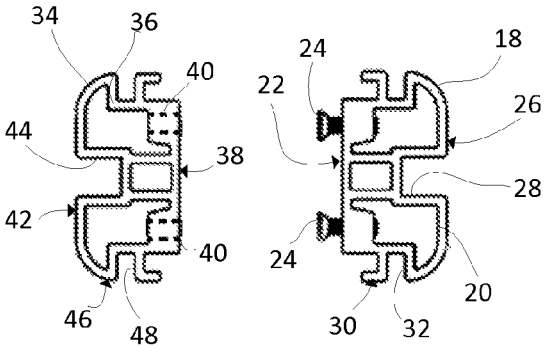
FIG. 2 illustrates a top view of support posts employing a dual pin/slot locking feature used in the system of FIG. 1.

FIG. 1 illustrates an embodiment of the modular booth system 10 of the present invention. The system 10 includes multi-component assemblies generally comprising panel support posts 12, corner support posts 14, support beams 16, wall panels (shown in FIG. 13), and/or other components. The system 10 is configured such that assembly of the various components facilitates the vertical support of wall panels for erecting temporary structures such as booths, stalls, enclosures, and/or other structures. It is noted that the depiction in the figure is not intended to be limiting, and in fact, the present inventions facilitates the assembly of temporary structures of essentially any size, dimension, length, and/or configuration deemed suitable by the user of the system 10. As such the depictions in the figures are for illustrative purposes only. The figures provided herein provide depictions of certain embodiments of the invention, while it is anticipated that those skilled in the art may recognize other methods, techniques, and/or embodiments for employing the various components and/or features of the system 10. However, without departing from the intent and scope of the present invention, such additional embodiments are considered part of this disclosure.

As shown In FIG. 1, support posts 12, corner posts 14, and support beams 16 can be operatively engaged to form individual modular wall assemblies 11, and/or other assemblies. During the vertical support of wall panels, the support posts 12 and corner posts 14 and are generally disposed vertically while the support beams 16 are generally disposed horizontally. The support beams 16 may be engaged at or near the bottom ends of the support posts 12 (e.g., a footer support beam) and/or at or near the top ends of the support posts 12 (e.g., header beams).

The individual assemblies 11 may be employed to secure one or more planar wall panels (FIG. 13) to form a barrier. Multiple assemblies 11 can thereafter be operatively engaged to form larger, more robust structures and variations thereof. The system 10 herein includes various features which allow support posts 12 and support beams 16 to engage in a manner which provides enhanced structural stability. These features, described in more detail herein, generally include dual locking pin and slot techniques employed on engaging surfaces of adjacent support posts 12, spring biased slide locking pins employed with the support beams 16, and/or additional features which will be brought out upon further description of the embodiments of the present invention.

In some embodiments, support beams 16 may be configured to engage support posts 12 by other techniques, for example, using pin/slot configurations, tongue and groove type fastening means, pressure locks, mechanical fasteners, and/or other techniques suitable for the intended purpose of engaging support beams 16 to support posts 14. For example, in some implementations the distal ends of a support beam 16 may be configured to include one or more tongue components while surfaces at or near the distal ends of support posts 12 may include cooperative tongue receiving grooves. Such operative means for engagement may be preferred for support beams 16 employed as header beams, which may require overhead assembly by the user and may substantially reduce the work required by the user to assemble.

Engagement of wall panels to the support posts 12, support beams 16, and corner supports posts 14 may be facilitated through the employment of panel engagement channels employed on one or more surfaces thereof, and/or other means for engaging planar wall panels thereto. Panel engagement channels may comprise one or more recessed channels running longitudinally along one or more surfaces of the support posts 12, corner support posts 14, and/or support beams 16. The channels may be configured to engage the side, top and bottom edges of the planar wall panels for vertical support thereof. As such, the support posts 12, corner support posts 14, and support beams 16 in operative engagement may form a type of frame (e.g., individual wall assemblies 11) and/or other support structure for supporting individual and/or multiple (e.g., stacked) wall panels. It is additionally contemplated that the system 10 is configured to allow interchangeability of wall panels from their engagement within the individual assemblies 11 to facilitate customizable aesthetics and/or structural support features of an assembly of the system 10.

The support posts 12, corner posts 14, and support beams 16 may be configured for removable engagement with accessories. Accessories may include, for example, shelves, posts, hangers, hooks, rods, and/or other accessories components. In some embodiments, removable engagement of accessories is provided through the employment of accessory engagement channels disposed on one or more surfaces of the support posts 12, corner posts 14, and support beams 16, described in more detail shortly below. Briefly, the accessory engagement channels may be configured for removable engagement with various fasteners, such as friction fasteners, mechanical fasteners, and/or other suitable fastener employed by accessories components for engagement with the system 10.

Exemplary embodiments of support posts 12, corner posts 14, and support beams 16, as well as another embodiment of the system 10 are described in more detail with reference made to FIGS. 2-13. It is noted that although the following descriptions are directed to particular embodiments of the support posts 12, corner posts 14, and support beams 16, it is to be understood that the particular features to be described for these particular components may be similarly carried out with the other support posts 12, corner posts 14, and support beams 16, respectively. As such the following descriptions and related figures are merely provided as illustrative examples and should not be considered limiting.

Referring now to FIG. 2-6, there are shown exemplary embodiments of a first support post 18 and second support post 34. The first support post 18 and second support post 34 may generally comprise at least one side of an individual wall assembly (e.g., assembly 11 shown in FIG. 1). As such, during construction of a more robust structure, it is intended that the first support post 18 and second support post 34 can be engaged together in order to engage multiple wall assemblies to form the robust structure. The components and manner in which respective surfaces of the first support post 18 and second support post 34 engaged together are described in more detail herein.

The first support post 18 may comprise a first end 20 and a second end (second end 21 shown in FIGS. 10A-C and FIG. 13), the second end being opposite the first end. The first support post 18 may comprise a first surface 22 running from the first end 20 to the second end thereof. The first surface 22 may comprising two adjacent pins 24 extending therefrom. In use, during vertical support of wall panels (see FIG. 13) the pins 24 may be horizontally disposed. The first support post 18 may comprise a second surface 26 running from the first end 20 to the second end 21 thereof. The second surface 26 may be a surface of the first support post 18 facing opposite the first surface 22. The second surface 26 may comprise a panel engagement channel 28 running longitudinally along the first support post 18. The first support post 18 may be configured with a first side surface 30 running from the first surface 22 to the second surface 26. The first side surface 30 may comprise one or more accessory engagement channels 32 running longitudinally along the first support post 18. The accessory engagement channel 32 may be configured to engage accessories as described previously herein, and/or by other techniques. In some implementations, described in more detail below, the second end 21 of the first support post 18 may comprise pin lock receiving apertures (e.g., such as apertures 67 and 71 shown in FIG. 10A).

Figure 13:
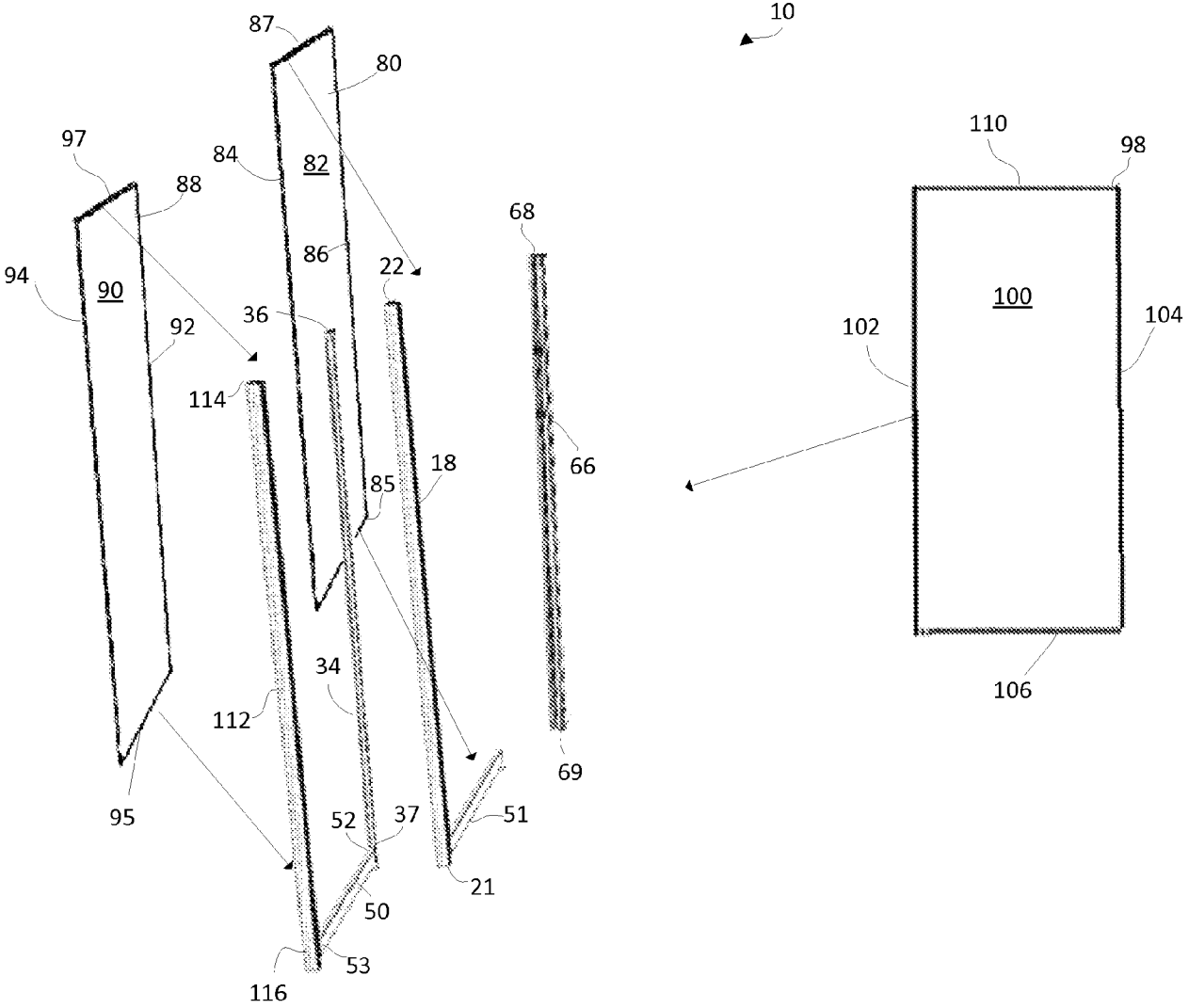
FIG. 13 illustrates an embodiment of the modular booth system.

Referring now to an embodiment of the system 10 shown in FIG. 13, the panel engagement channel (e.g., panel engagement channel 28 shown in FIGS. 2-6) of the first support post 18 may be configured to engage a first side edge 84 of a first planar wall panel 80. Briefly, the first wall panel 80 may comprise a first planar surface 82, a second planar surface opposite the first planar surface 82 (not shown), a first side edge 84, a second side edge 86 opposite the first side edge 84, a bottom edge 85, and a top edge 87 opposite the bottom edge 85.

Returning to FIGS. 2-6, the second support post 34 may comprise a first end 36 and a second end (e.g., second end 37 shown in FIGS. 8-10C and FIG. 13), the second end being opposite the first 36. The second support post 34 may comprise a first surface 38 running from the first end 36 to the second end thereof. The first surface 38 may comprise two adjacent slots 40 communicating through the first surface 38 and running longitudinally along the second support post 34. In use during vertical support of wall panels (see FIG. 13), the slots 40 may be horizontally disposed. In some implementations, the second end of the second support post 34 may comprise pin lock receiving apertures (e.g., such as apertures 64 and 65 shown in FIG. 9).

Figure 3:
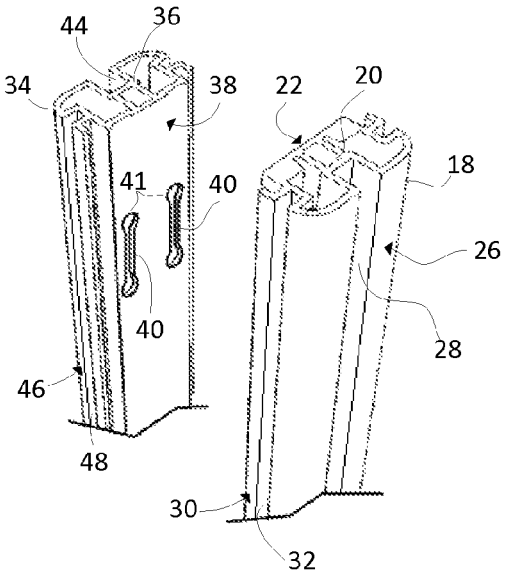
FIG. 3 illustrates a first perspective view of the support posts of FIG. 2.
Figure 4:
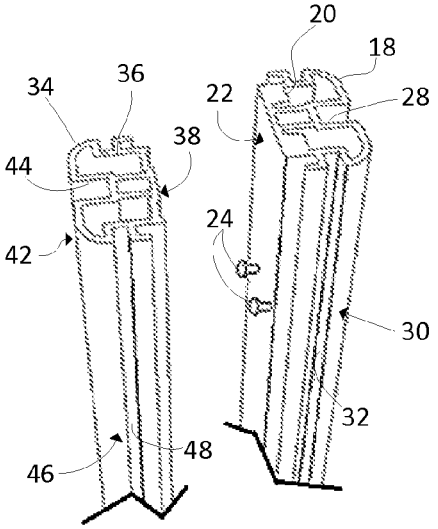
FIG. 4 illustrates a second perspective view of the support posts of FIG. 2.

The slots 40 may be configured with terminating distal ends 41 which are formed wider than the substantially central portion of the slots 40, as clearly shown in FIG. 3. The terminating ends 41 may be configured to receive the heads of the pins 24 of the first support post 18 and thereafter facilitate translation of the first support post 18 into a locked engagement with the second support post 34 wherein the head of the pins 24 may translate at or near the substantially central portion of the slots 40 between the wider terminating ends 41, such that the first support post 18 and second support post 34 are in a locked engagement. This locked engagement may require the first support post 18 and second support post 34 to be slid (e.g., translated) relative each other in order to re-register the pin 24 heads with the distal ends 41 of the slots 40 to allow the second support post 34 and first support post 18 disengage the pin/slot components. Other configurations of pins/slots are also contemplated.

Figure 5:
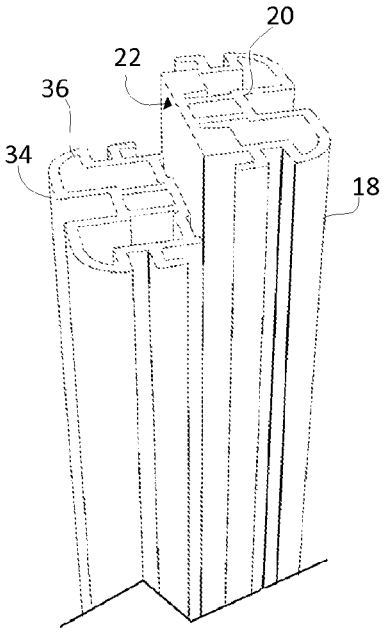
FIG. 5 illustrates a third perspective view of the support posts of FIG. 2 showing the engagement of the pin/slot locking feature of the system.
Figure 6:
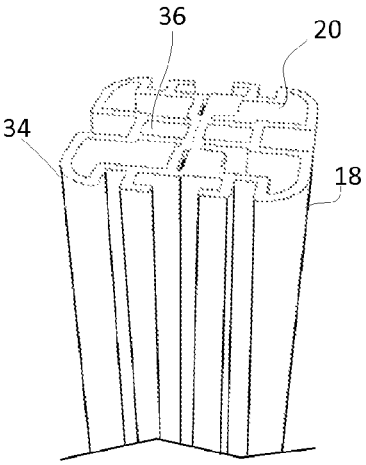
FIG. 6 illustrates a fourth perspective view of the support posts of FIG. 2 depicting the posts in the locked positioned.

The procedure of engaging (and/or disengaging when the operations are reversed) the pins 24 and slots 40 of the first support post 18 and second support post 34, respectively, is shown in general by the sequential depictions of FIGS. 5-6. FIG. 5 generally shows the engagement the first support post 18 and second support post 34 wherein the pins 24 are positioned to register with the distal ends 41 of the slots 40 such that the pins 24 may be communicated into the slots 40. FIG. 6 generally shows the translation of the first support post 18 relative the second support post 34 such that the pins 24 will be positioned at or near the substantially central region of the slots 40 between the distal ends 41 such that the first support post 18 and second support post 34 are locked in their engagement. It is particularly noted that experimentation has shown that the employment of the dual, horizontally disposed pin 24/slot 40 configurations as shown and described herein for engaging adjacent support posts (e.g., first support post 18 and second support post 34) provides substantially enhanced structural rigidity in the assembled system 10 (for example, the assemblies shown in FIG. 1 and FIG. 13), and is especially preferred.

It is noted that the location of the pins 24 and slots 40 along the length of the first support post 18 and second support post 34, respectively, can be of the designers choice and are not limited to being disposed substantially adjacent the first ends 20, 36 of the first support post 18 and second support post 34, respectively, as shown in the figures. As such it is to be understood that the location of the pins 24 and slots 40 configuration can be of the system 10 designer's choice. It is additionally contemplated that the first support post 18, second support post 34, and/or other support posts may include multiple sets of pins 24 and slots 40 respectively. For example, a first support post 18 may include a set of pins 24 located adjacent the first end 20, and a second set of pins 24 located adjacent the second end (e.g., second end 21 shown in FIGS. 10A-C and FIG. 13). In this example, the second support post 34 may comprise two sets of slot 40 configurations in similar locations as that of the pins 24 on the first support post 18.

In FIGS. 2-6, the second support post 34 may comprise a second surface 42 running from the first end 36 to the second end 37 thereof. The second surface 42 may be a surface of the second support post 34 facing opposite the first surface 38. The second surface 42 may comprise a panel engagement channel 44 running longitudinally along the second support post 34. The second support post 34 may be configured with a first side surface 46 running from the first surface 38 to the second surface 42. The first side surface 46 may comprise one or more accessory engagement channels 48 running longitudinally along the second support post 34. The accessory engagement channel 48 may be configured to engage accessories by techniques described previously herein, and/or by other techniques.

Referring now to an embodiment of the system 10 shown in FIG. 13, the panel engagement channel (e.g., channel 44 shown in FIGS. 2-6) of the second support post 34 may be configured to engage a first side edge 92 of a second planar wall panel 88. Briefly, the second wall panel 88 may comprise a first planar surface 92, a second planar surface opposite the first planar surface 90 (not shown), a first side edge 92, a second side edge 94 opposite the first side edge 92, a bottom edge 95, and a top edge 97 opposite the bottom edge 85. It is additionally noted, as described previously for FIG. 2-6, the adjacent slots of the first surface of the second support post 34 in an engagement with the adjacent pins of the first surface of the first support post 18 substantially eliminates rotation of the first support post 18 relative the second support post 34 during the vertical support of wall panels 80, 88, to thereby substantially enhance the structural rigidity of the system 10 assembly.

Figure 7:
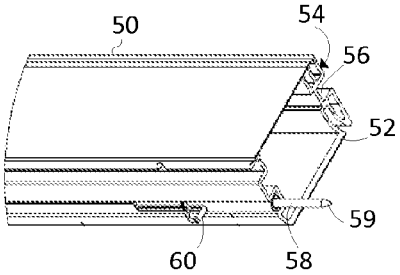
FIG. 7 illustrates a bottom perspective view of a support beam with slide locking pin employed in the system of FIG. 1.

FIG. 7 illustrates an exemplary embodiment of a support beam, depicted currently as first support beam 50. In use, during the vertical support of wall panels (shown in FIG. 1 and FIG. 13), the support beams (e.g., first support beam 50) are configured for horizontal support of the support posts (e.g., such as the second support post 34 and a third support post 112 in FIG. 13). The first support beam 50 may comprise a first end 52 as depicted in the figure.

Figure 8:
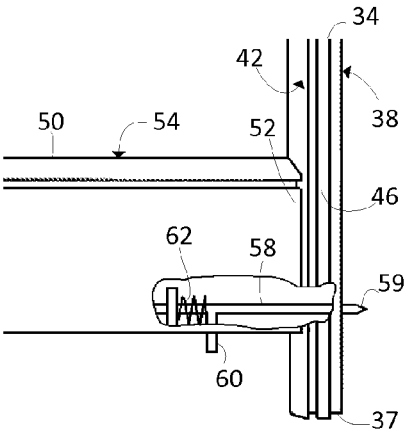
FIG. 8 illustrates a side view of the beam of FIG. 7 engaged to a second end of a support post as part of the assembly of the booth system.
Figure 9:
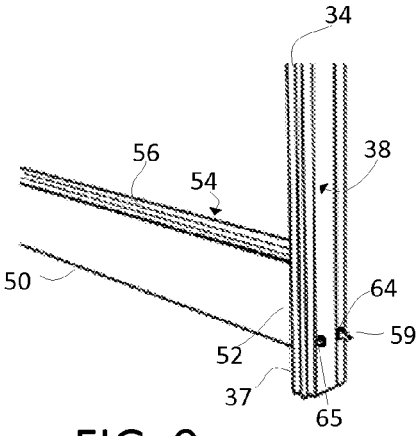
FIG. 9 illustrates a perspective view of the engaged beam and support of FIG. 8.

Shown in FIG. 8 and FIG. 9, the first end 52 may be configured to engage the second surface 42 adjacent the second end 37 of the second support post 34. The first end 52 of the first support beam 50 may include a first translatable biased locking pin 58 extending longitudinally therefrom. The first locking pin 58 may be biased by means of a spring 62, and/or other biasing technique, such that the distal end 59 of the first locking pin 58 is biased longitudinally away from the first end 52 of the first support beam 50. The second end 53 opposite the first end 52 (shown in FIG. 13) may include a second translatable biased locking pin (not shown) which substantially mirrors the configuration of the first locking pin 58 shown in the current figures. The first biased locking pin 58 (and/or other biased locking pins) may be configured to translate into a biased engagement through pin lock receiving apertures (e.g., first aperture 64 communicating from the second surface 42 to the first surface 38 of the second support post 34) of the second support post 34 during the vertical support of wall panels thereof, such that a distal end 59 of the first pin 58 is extendable through the first aperture 64 and past the first surface 38 of the second support post 34.

As shown in FIG. 9, the second support post 34 may comprise a second pin lock receiving aperture 65 communicating through the second support post 34 from the second surface 42 to the first surface 38, and positioned adjacent the first aperture 64. The second aperture 65 may be employed for receiving a locking pin employed on a support beam engaged to an adjacent support post. For example, referring to FIG. 10A, a second support beam 51 may be engaged to the first support post 18, wherein the second support beam 51 includes a third translatable biased locking pin 61, such that engagement of the second support beam 51 to the first support post 18 includes the third locking pin 61 extending through a third aperture 67 communicating through the first support post 18 and disposed adjacent the second end 21 of the first support post 18. The engagement of the first support post 18 and the second support post 34 (e.g., according to the pin/slot lock procedure depicted in FIG. 5 and FIG. 6) may include the third locking pin 61 extending from the first surface 22 of the first support post 18 and communicating into the second aperture 65 of the second support post 34. In addition, the first locking pin 58 extending from the second support post 34 may communicate into a forth aperture 71 disposed adjacent the third aperture 67 positioned near the second end 21 of the first support post 18. The locking pins may include handles (e.g., first locking pin 58 may include a first handle 60) to facilitate user translation of the locking pins as needed during system 10 assembly.

The first support beam 50 may be configured to include a first surface 54 running between the first end 52 and second end thereof. The first surface 54 may comprise a panel engagement channel 56 running longitudinally along the first support beam 50. In FIG. 13, the panel engagement channel (e.g., panel engagement channel 56 of FIG. 9) of the first support beam 50 may be configured to engage the bottom edge 95 of the second wall panel 88 during the vertical support of the second wall panel 88 thereof.

Figure 10A:
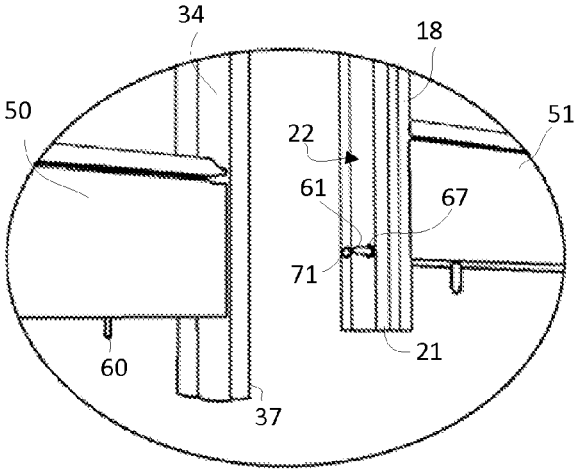
FIG. 10A illustrates a first view of the engagement of support posts similar to FIG. 4 however showing ends opposite that shown in FIG. 4.
Figure 10B:
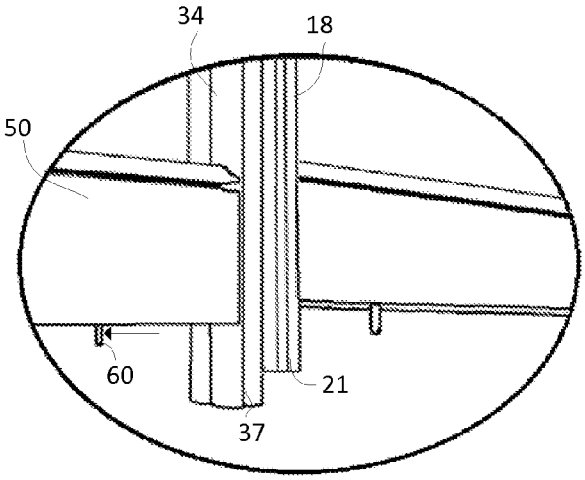
FIG. 10B illustrates a second view of the engagement of support posts similar to FIG. 5 however showing ends opposite that shown in FIG. 5.
Figure 10C:
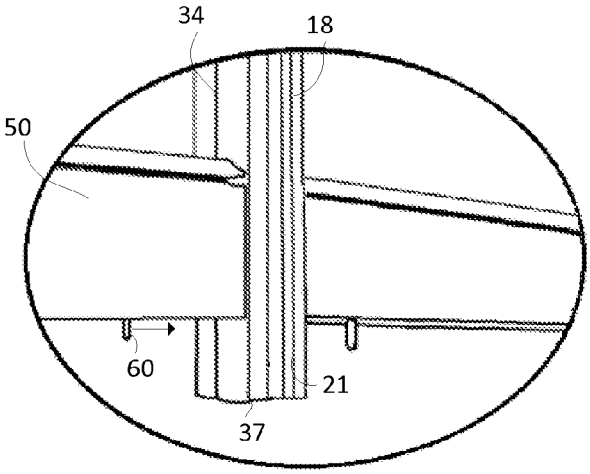
FIG. 10C illustrates a third view of the engagement of support posts similar to FIG. 6 however showing ends opposite that shown in FIG. 6.

FIG. 10B and FIG. 10C show generally the engagement procedure of adjacent support posts (e.g., first support post 18 and second support post 34) engaged to support beams having locking pins (e.g., first support beam 50 and second support beam 51), in accordance with the pin/slot locking procedure shown previously in FIG. 5 and FIG. 6. FIG. 10B generally depicts the same procedural step as shown in FIG. 5, while FIG. 10C generally depicts the same procedural step as shown in FIG. 6. The locking pin/receiving aperture configuration has been experimentally shown to provide enhanced structural rigidity in the system 10 assembly.

Figure 11:
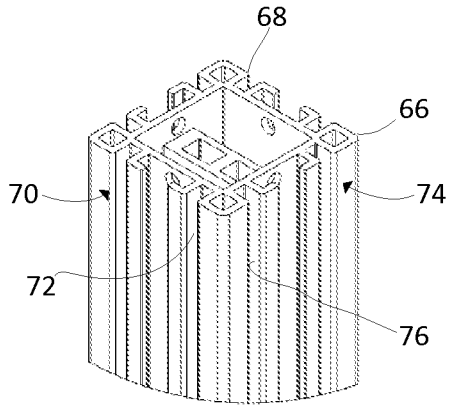
FIG. 11 shows a perspective view of a first end of a corner support post employed in the system of FIG. 1.
Figure 12:
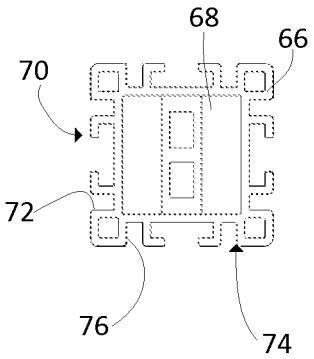
FIG. 12 shows a top view of the corner support post of FIG. 11.

FIG. 11 and FIG. 12 depict an exemplary embodiment of a corner support post, currently showing a first corner support post 66. The first corner support post 66 may comprise a first end 68 and a second end opposite the first end 68 (e.g., second end 69 shown in FIG. 13). The first corner support post 66 may comprise a first surface 70 running from the first end 68 to the second end thereof. The first surface 70 may comprise one or more panel engagement channels 72 running longitudinally along the first corner support post 66. The first corner support post 66 may comprise a second surface 74 running from the first end 68 to the second end thereof. The second surface 74 may be positioned adjacent to the first surface 70. The second surface 74 may comprise one or more panel engagement channels 76 running longitudinally along the first corner support post 66.

Referring now to FIG. 13, the panel engagement channel (e.g., panel engagement channel 72 shown in FIG. 11-12) of the first surface of the first corner support post 66 may be configured to engage the second side edge 86 of the first wall panel 80. The panel engagement channel (e.g., panel engagement channel 76 shown in FIG. 11-12) of the second surface of the first corner support post 66 may be configured to engage a first side edge 102 of a third wall panel 98. Briefly, the third wall panel 98 may comprise a first planar surface 100, a second planar surface opposite the first planar surface 100 (not shown), a first side edge 102, a second side edge 104 opposite the first side edge 102, a bottom edge 106, and a top edge 110 opposite the bottom edge 106.

FIG. 13 depicts an embodiment of the system 10 wherein the engagement of the first wall panel 80, second wall panel 88, and the third wall panel 98 to their respective components as described above form a corner assembly. It is noted that the depiction in FIG. 13 provides merely a single example of an assembly of the system 10 and is provided herein for illustrative purposes only.

In the figure there is additionally shown a third support post 112. The third support post 112 may be the same as or similar to the first support post 18. For example, the third support post 112 may comprise a first end 114 and a second end 116 opposite the first end 114. The third support post 112 may comprise a first surface (e.g., similar to first surface 22 of the first support post 18 shown in FIG. 2-6) running from the first end 114 to the second end 116 thereof. The first surface of the third support post 112 may comprise two adjacent pins extending therefrom (e.g., similar to pins 24 of the first support post 18 shown in FIG. 2-6), wherein the pins are horizontally disposed during the vertical support of wall panels. The third support post 112 may comprise a second surface (e.g., similar to the second surface 26 of the first support post 18 in FIG. 2-6) running from the first end 114 to the second end 116, wherein the second surface is facing opposite the first surface. The second surface of the third support post may comprise a panel engagement channel (e.g., similar to panel engagement channel 28 of first support post 18 shown in FIG. 2-6) running longitudinally along the third support post 112. The panel engagement channel of the third support post 112 may be configured to engage the second side edge 94 of the second wall panel 88. The third support post 112 may comprise a first side surface (e.g., similar to first side surface 30 of the first support post 18 shown in FIG. 2-6) running from the first surface to the second surface thereof. The first side surface of the third support post 112 may comprise an accessory engagement channel (e.g., similar to accessory engagement channel 32 of the first support post 18 shown in FIG. 2-6) running longitudinally along the third support post 112.

The second end 53 of the first support beam 50 may include a second translatable biased locking pin (e.g., a mirrored configuration of the first locking pin 58 shown in FIG. 7) extending longitudinally therefrom, wherein the second biased locking pin may be configured to translate into a biased engagement within a receiving aperture (e.g., similar to the receiving aperture 67 of the first support post 18 shown in FIG. 10A) of the third support post 112, wherein the third support post 112 is engaged to the second side edge 94 of the second wall panel 88.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A modular booth system including support posts providing vertical support of wall panels, the system comprising:

a first support post comprising:

a first end;

a second end opposite the first end;

a first surface running from the first end to the second end thereof, the first surface comprising two adjacent pins extending therefrom, wherein the pins are horizontally disposed during the vertical support of wall panels;

a second surface running from the first end to the second end, the second surface facing opposite the first surface, the second surface comprising a first panel engagement channel running longitudinally along the first support post, wherein the first panel engagement channel is configured to engage a first side edge of a first wall panel;

a first side surface running from the first surface to the second surface, the first side surface comprising a first accessory engagement channel running longitudinally along the first support post, wherein the first accessory engagement channel is configured to engage accessories therein;

a second support post comprising:

a third end;

a fourth end opposite the third end;

a third surface running from the third end to the fourth end thereof, the third surface comprising two adjacent slots, wherein the slots are horizontally disposed during the vertical support of wall panels, wherein the slots are configured for secure removable engagement with the two adjacent pins of the first surface of the first support post during the support of wall panels;

a fourth surface running from the third end to the fourth end, the fourth surface facing opposite the third surface, the fourth surface comprising a second panel engagement channel running longitudinally along the second support post, wherein the second panel engagement channel is configured to engage a second side edge of a second wall panel;

a second side surface running from the third surface to the fourth surface, the second side surface comprising a second accessory engagement channel running longitudinally along the second support post, wherein the second accessory engagement channel is configured to engage accessories therein; and wherein the adjacent slots of the first third surface of the second support post in an engagement with the adjacent pins of the first surface of the first support post eliminates rotation of the first support post relative the second support post during the vertical support of wall panels thereof.

2. The system of claim 1 additionally comprising:

a third support post comprising:

a fifth end;

a sixth end opposite the fifth end;

a fifth surface running from the fifth end to the sixth end thereof, the fifth surface comprising two adjacent secondary pins extending therefrom, wherein the secondary pins are horizontally disposed during the vertical support of wall panels;

a sixth surface running from the fifth end to the sixth end, the sixth surface facing opposite the fifth surface, the sixth surface comprising a third panel engagement channel running longitudinally along the third support post, wherein the third panel engagement channel is configured to engage a third side edge of the second wall panel, the third side edge facing opposite the second side edge; and a third side surface running from the fifth surface to the sixth surface, the third side surface comprising a third accessory engagement channel running longitudinally along the third support post, wherein the third accessory engagement channel is configured to engage accessories therein.

3. The system of claim 1 additionally comprising:

a corner support post comprising:

a seventh end;

an eighth end opposite the seventh end;

a seventh surface running from the seventh end to the eighth end thereof, the seventh surface comprising a fourth panel engagement channel running longitudinally along the corner support post, wherein the fourth panel engagement channel is configured to engage a fourth side edge of the first wall panel, the fourth side edge of the first wall panel facing opposite the first side edge thereof;

an eighth surface running from the seventh end to the eighth end thereof, the eighth surface positioned adjacent to the seventh surface, the eighth surface comprising a fifth panel engagement channel running longitudinally along the corner support post, wherein the fifth panel engagement channel is configured to engage a fifth side edge of a third wall panel; and whereby, the engagement of the third wall panel to the fifth panel engagement channel of the eighth surface and the engagement of the first wall panel to the fourth panel engagement channel of the seventh surface form a corner.

4. The system of claim 1 additionally comprising:

the second end of the first support post additionally comprising a first in lock receiving aperture communicating from the second surface to the first surface thereof;

the fourth end of the second support post additionally comprising a second pin lock receiving aperture communicating from the fourth surface to the third surface thereof;

a first support beam configured for horizontal support of the support posts during the vertical support of wall panels, the first support beam comprising:

a ninth end configured to engage the fourth surface adjacent the fourth end of the second support post, the ninth end of the first support beam including a first translatable biased locking pin extending longitudinally therefrom, wherein the first translatable biased locking pin is configured to translate into a biased engagement through the second pin lock receiving aperture of the fourth end of the second support post and the first pin lock receiving aperture of the second end of the first support post during the vertical support of wall panels thereof such that a distal end of the pin is extendable past the third surface of the second support post and into the first surface of the first support post;

a tenth end opposite the ninth end; and a ninth surface running between the ninth end and tenth end thereof, the ninth surface comprising a sixth panel engagement channel running longitudinally along the first support beam wherein the sixth panel engagement channel is configured to engage a bottom edge of the second wall panel during the vertical support of the second wall panel thereof.

5. The system of claim 4 wherein the tenth end of the first support beam includes a second translatable biased locking pin extending longitudinally therefrom, wherein the second translatable biased locking pin is configured to translate into a biased engagement within a third in lock receiving aperture of a third support post engaged to a third side edge of the second wall panel, the third side edge facing opposite the first second side edge.

* * * * *